United States Patent [19]

Bergstrom

[11] 4,311,585

[45] Jan. 19, 1982

[54] CLASSIFICATION OF PARTICULATE MATERIAL

[75] Inventor: Otto T. Bergstrom, Wilropark, South Africa

[73] Assignee: Egberg Patents (Pty.) Limited, Johannesburg, South Africa

[21] Appl. No.: 122,491

[22] Filed: Feb. 19, 1980

[30] Foreign Application Priority Data

| | | | |
|---|---|---|---|
| Feb. 19, 1979 | [ZA] | South Africa | 79/770 |
| Apr. 25, 1979 | [ZA] | South Africa | 79/2052 |
| Dec. 6, 1979 | [ZA] | South Africa | 79/6692 |

[51] Int. Cl.[3] ..... B03B 5/58; B03B 5/62

[52] U.S. Cl. ..... 209/211; 233/27; 209/452; 209/453

[58] Field of Search ..... 209/155, 211, 445, 451–453; 233/3, 10, 16, 27

[56] References Cited

U.S. PATENT DOCUMENTS

| | | | |
|---|---|---|---|
| 823,948 | 6/1906 | Kaehl | 233/27 X |
| 1,098,497 | 6/1914 | Hardinge | 209/451 |
| 1,542,747 | 6/1925 | Verney | 233/10 |
| 2,146,716 | 2/1939 | Bennett | 209/199 |
| 2,179,941 | 11/1939 | Lindgren | 233/27 |
| 3,933,638 | 1/1976 | Isley | 210/360 X |

FOREIGN PATENT DOCUMENTS

| | | | |
|---|---|---|---|
| 276257 | 11/1969 | Austria | 233/3 |
| 1198296 | 8/1965 | Fed. Rep. of Germany . | |
| 712081 | 9/1931 | France . | |

*Primary Examiner*—Ralph J. Hill

*Attorney, Agent, or Firm*—Cushman, Darby & Cushman

[57] ABSTRACT

In this invention a method and apparatus for treating particulate material are provided. The apparatus includes a rotatable cylindrical vessel with a concentrate outlet near its operatively lowest part and a particulate feed inlet and a tailings outlet above the concentrate outlet. Means are included in the apparatus for preventing particles packing together at the cylindrical wall during rotation of the vessel.

11 Claims, 5 Drawing Figures

CLASSIFICATION OF PARTICULATE MATERIAL

This invention relates to the treatment of particulate material according to the specific gravity of the particles of the material.

To separate particles of a material according to their specific gravities is well known. In a method of doing this the particles of material are subjected to a centrifugal force so that the higher specific gravity particles of the material tend to move outwards and downwards under the influence of the centrifugal and gravitational force to a greater extent than the lower specific gravity particles.

This principle has been extensively used in particle classifiers such as cyclones and classification cones, for example; achieving a size classification of mineral particles.

One type of apparatus comprises a rotatable cylinder having a vertical axis and into which a fluid carrying the particulate material is fed. The rotation of the cylinder is imparted to the fluid and material and the latter separates into particles of different specific gravities. The particles with a high specific gravity tend to move outwards and downwards to a greater extent relative to the lower specific gravity particles.

Several problems are encountered in this type of classifier.

Firstly if the particles have a wide size range the small particles of high specific gravity tend to behave as if they have a low specific gravity and the large particles of low specific gravity tend to behave as if they have a high specific gravity.

Secondly as the cylinder is rotated faster a rotational speed is reached at which the particles 'stick' to the cylinder wall under the centrifugal force. This is commonly known as the 'critical speed' and is reached sooner for small particles than for large particles and often results in bands of tightly packed particles adhering to the cylinder wall before the critical speeds for the larger particles are reached.

Both of the above problems result in the need for a close sizing of the particulate material feed. Sizing of this nature is both inefficient and requires costly apparatus and further classifiers to treat the various size ranges. This is impractical and is not often done. As a result the efficiencies of classifiers in use are often low with poor separation characteristics. In this specification treating, treatment or recovery of particulate material means separating the material according to the specific gravities of its particulate constituents.

An object of the invention is to provide an apparatus for and a method of separation in which the above problems are at least decreased..

It should be noted that although extensive reference will be made in this specification to the use of the invention in the treatment of mineral particles, this should not be considered in any way as a restriction on the application of the invention.

According to the invention an apparatus for treating particulate material comprises:

- a cylindrical vessel rotatable about its axis;
- a concentrate outlet near the operatively lowest part of the vessel;
- a tailings outlet above the concentrate outlet;
- a feed inlet above the concentrate outlet; and

- means for preventing particles from packing together at the cylindrical wall of the vessel during rotation thereof.

According to a first aspect of the invention the vessel is open at the top thereof and is mounted so that its axis is substantially upright in operation.

Further according to the first aspect there are means for rotating the vessel and the vessel is right circular cylindrical or decreases in diameter towards its top.

In a first form of the first aspect the means for preventing particles from packing at the cylindrical wall comprises a primary flat static member located adjacent the wall inside the vessel to extend up at least the height of the vessel corresponding to the area of the vessel in which the higher specific gravity particles are collected. This primary static member is preferably a thin walled annular cylindrical member co-axial with the vessel and there may be at least one secondary static member spaced inwardly from the primary static member.

Furthermore, this form of the first aspect includes at least one annular cylindrical member spaced inwardly from the cylindrical wall of the vessel, spaced from the bottom thereof, and rotatable with the vessel.

In a second form of the first aspect the means for preventing particles from packing at the cylindrical wall comprises means for continuously removing material from the vessel via the concentrate outlet and recirculating it to the vessel.

According to a second aspect of the invention, the cylindrical vessel comprises an elongated cylinder open at each end and having a maximum diameter near the centre, the vessel being mounted for rotation such that its axis is substantially horizontal and having the feed inlet at one open end of the vessel, the tailings outlet at the other open end of the vessel and the concentrate outlet at the lowest part of the maximum diameter of the vessel.

Further according to this second aspect of the invention the cylindrical wall comprises two adjacent frustoconical sections, the means for preventing particles from adhering to the cylindrical wall comprises a plurality of spaced annular static discs co-axially mounted within the vessel, the periphery of the discs being spaced from the cylindrical wall of the vessel.

The invention also provides a method of treatment of particulate material using an apparatus as defined above, comprising:

- rotating the cylindrical vessel about its axis;
- introducing particulate material dispersed in a fluid into the vessel through the feed inlet;
- removing the lower specific gravity tailings through the tailings outlet and removing the higher specific gravity concentrate through the concentrate outlet.

The invention also provides a method of concentration using an apparatus as defined in the second form of the first aspect as defined, the method comprising:

- rotating the cylindrical vessel about its axis;
- introducing particulate material dispersed in a fluid into the vessel through the feed inlet;
- removing the lower specific gravity tailings through the tailings outlet;
- removing the higher specific gravity concentrate through the concentrate outlet and recirculating at least the major part of this concentrate until a concentrate bed having the required characteristics has built up in the vessel; and removing at least a portion of the concentrate bed via the concentrate outlet.

Several embodiments of this invention are now to be described by way of example only. Reference is made to the accompanying drawings in which.

Figure 1:
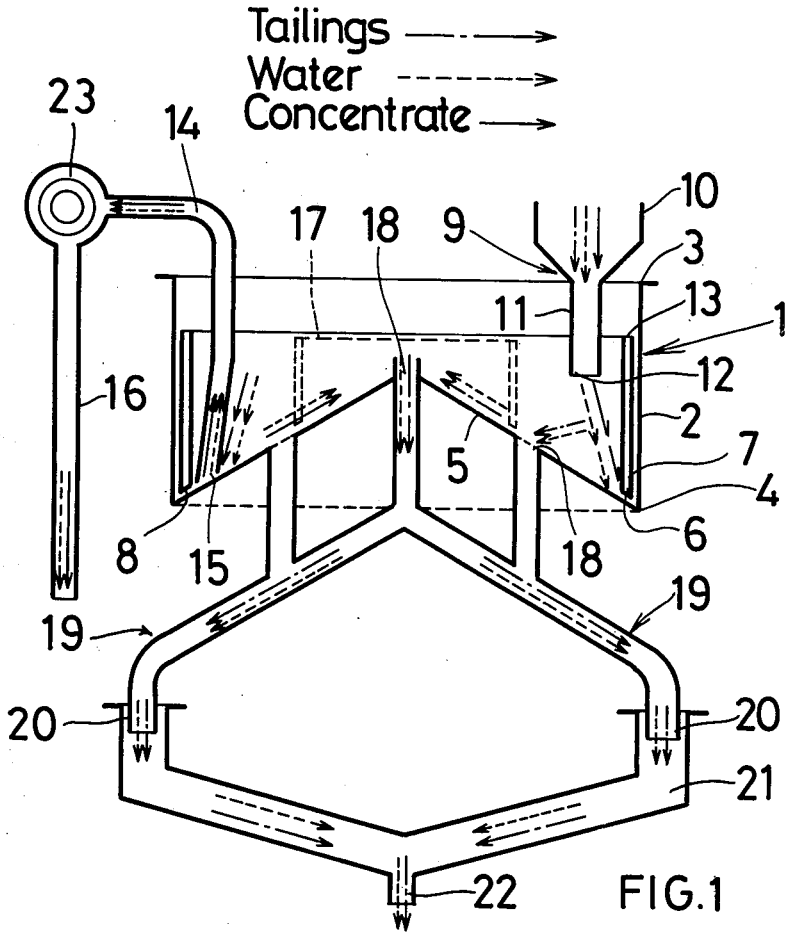
FIG. 1 is a diagrammatic cross-sectional elevation and flow diagram of a first embodiment of the invention.
Figure 2:
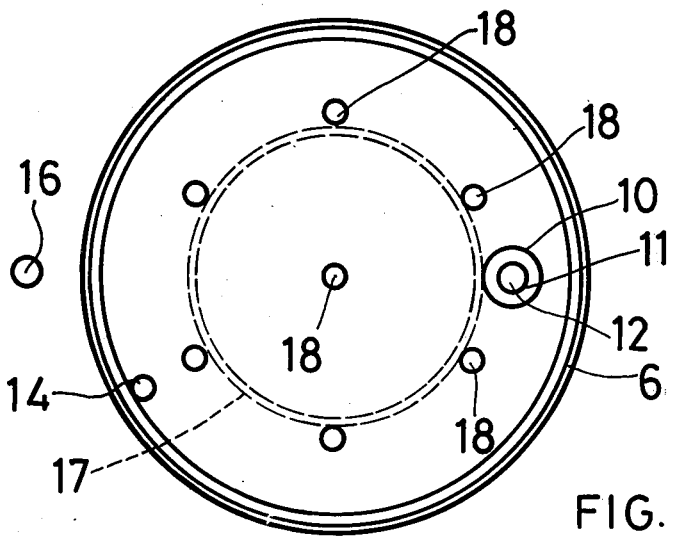
FIG. 2 is a diagrammatic plan of the first embodiment.

In the first embodiment as indicated in FIGS. 1 and 2, an apparatus for concentrating particulate mineral ores according to their specific gravities comprises a steel vessel 1 having a right circular cylindrical wall 2. The vessel 1 is open at the one end, hereinafter referred to as the top end 3 and has its other end, the bottom end 4, closed by a frusto-conical bottom 5 which is co-axial with the vessel and extends into the interior thereof.

The vessel 1 is mounted with its axis substantially vertical and its top end 3 uppermost. Furthermore, the vessel may be rotated about its axis and thus includes means whereby it may be rotated in the form of a suitable mounting and drive mechanism and also rotating means in the form of an electric motor for example. Neither of these features are indicated in the drawings as their exact nature is not important to the invention.

A primary static member 6 in the form of a thin wall annular cylindrical member is located inside the vessel 1 using a suitable superstructure to keep it in place. This static member which is also of steel construction is spaced from the cylindrical walls of the vessel by a small gap 7 and from the frusto-conical bottom 5 by a small gap 8.

A feed inlet 9 comprises a hopper 10 which discharges via an inlet pipe 11 into the vessel. The outlet orifice 12 of the pipe 11 is located adjacent the static member 6 and just below the top edge 13 thereof.

A concentrate outlet comprises an outlet pipe 14, the inlet 15 to which is located adjacent the bottom 5 of the vessel and also the static member. The outlet pipe 14 leads to a suction pump 15 and thereafter to pipe 16.

A plurality of tailings outlets 18 are located in the frusto-conical bottom 5. The main outlet is located in the centre top of the bottom while the secondary outlets are arranged in the form of a circle midway between the main tailings outlet and the concentrate outlet. These secondary outlets may be opened and closed.

The tailings outlets 18 are connected to a branched manifold 19 which discharges via downwardly extending pipes 20 into an annular launder 21. This launder discharges via a central outlet 22 to waste.

In use the vessel 1 is rotated about its axis and particulate ore material dispersed in a suitable volume of water is fed into the vessel 1 via the feed inlet 9. The water in the vessel extends to at least above the main tailings outlet 18.

As the vessel rotates the water and feed particles are also rotated and the feed particles are forced outwardly by centrifugal forces. They are forced against the primary static member which creates a drag on them thus maintaining them in constant movement and loose suspension. This prevents adherence of any of the particles to the wall of the vessel or in fact to the static member and enables the vessel to be rotated at speeds in excess of the critical speed of a vessel without the static member. Furthermore, the loose suspension enables the particles of high specific gravity, no matter what their size is, to move outwardly and downwardly relative to the particles of lower specific gravity also irrespective of size.

With the build-up of higher specific gravity particles the particles of lower specific gravity are forced up the slope of the frusto-conical bottom 5 and out of at least the main tailings outlet 18. If large quantities of tailings are to be removed the secondary outlets may be opened.

The particles of higher specific gravity are collected through the pipe opening 15 from adjacent the static member by the pump 23 and delivered where required via pipe 16.

One or more further secondary static members of the same type as the primary static member 7 may be incorporated in the vessel. These secondary static members are co-axial with the vessel but spaced inwardly from the primary static member. An example of such a secondary static member is shown in dotted lines in FIG. 1 and denoted by numeral 17.

The secondary static members function in the same way as the primary static members with the concentrate escaping through gaps at the bottom of these members until the primary static member is reached. The number of secondary static members used depends largely on the diameter and size of the vessel.

Figure 3:
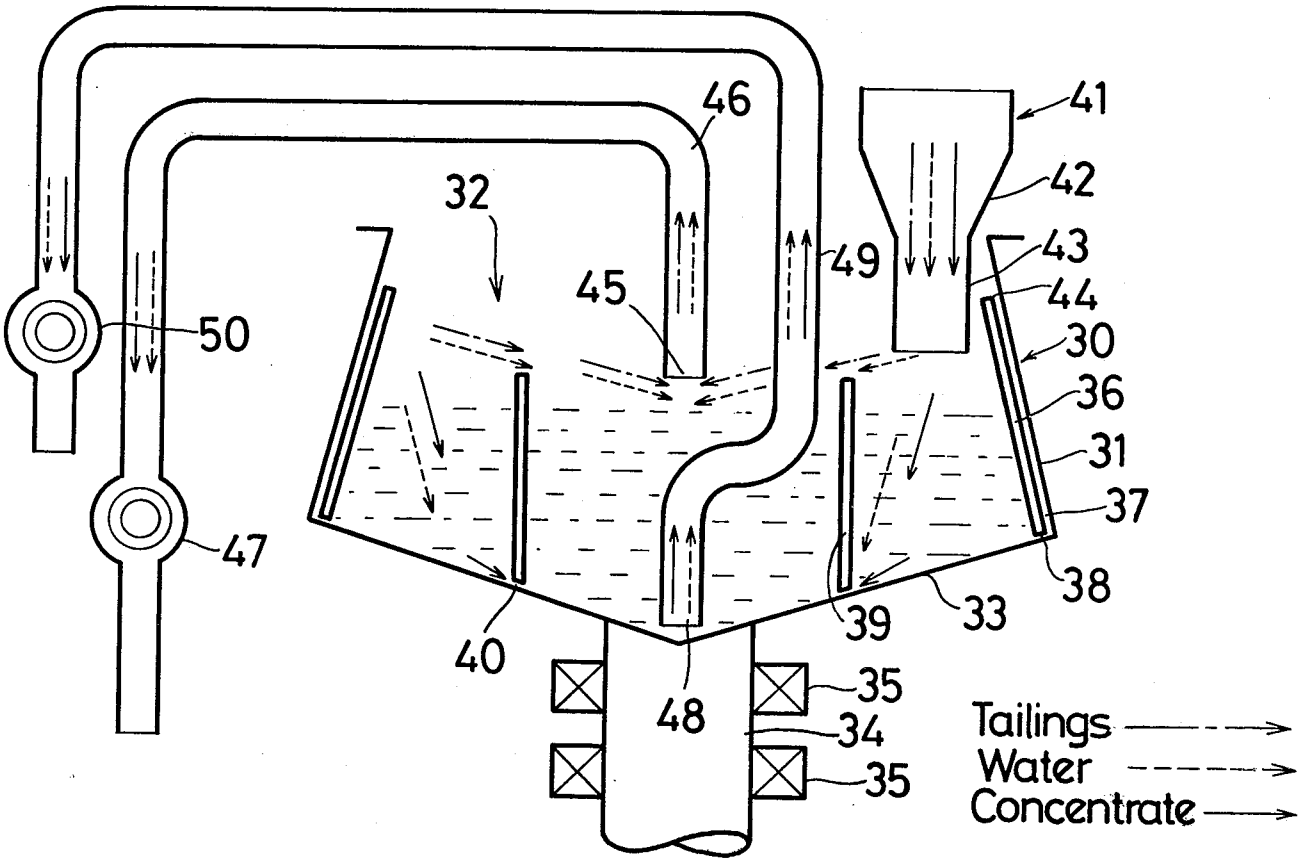
FIG. 3 is a diagrammatic cross-sectional elevation and flow diagram of a second embodiment of the invention.

In the second embodiment as shown in FIG. 3, the apparatus comprises a cylindrical vessel 30, the cylindrical wall 31 of which tapers slightly inwardly towards the open top 32 thereof. The bottom 33 of the vessel is frusto-conical with the apex lowermost.

A drive shaft 34 is fixed co-axially to the bottom 33 and is located in suitable bearings 35 thus rotatably mounting the vessel 30. The drive shaft is rotatable by suitable drive means in the form of an electric motor, for example.

Adjacent the inside of the cylindrical wall 31 and parallel thereto is a thin walled cylindrical primary static member 36 which is mounted to a suitable superstructure (not shown). As in the case of the first embodiment the static member is spaced by small gaps 37 and 38 from the cylindrical wall 31 and the bottom 33 respectively.

A thin walled rotational member 39 is located midway between the primary static member 36 and the centre of the bottom 33. This rotational member is right circular cylindrical and spaced from the bottom 33 by a small gap 40 but is attached to the vessel so that it rotates therewith.

A particulate feed inlet 41 comprising a hopper 42 and inlet pipe 43 feeds into the top of the vessel 30 adjacent and just below the top 44 of the static member 36.

A tailings outlet 45 is located just below the feed inlet but in the centre of the vessel 30. This outlet is formed by the end of a pipe 46 which extends upwardly from the vessel and leads to a tailings suction pump 47 and from there to waste.

A concentrate outlet 48 is located adjacent the apex of the bottom 33 of the vessel. A pipe 49 leads upwardly from the concentrate outlet to a suction pump 50 and from there to a concentrate bin.

In use particulate material dispersed in water is fed into the rotating vessel 30 via the feed inlet 41.

The ore particles are forced by centrifugal forces towards the cylindrical wall 31. As the solids content of the vessel 30 increases the amount of higher specific gravity particles increases at the cylindrical wall. These particles then begin flowing downwardly and find their way below the revolving member 39 to the concentrate outlet 48 and are removed from the vessel by the suction pump 50.

Simultaneously the particles of lower specific gravity are forced by the build-up of concentrate or higher specific gravity particles to flow inwardly at a higher level in the vessel. They are then removed via the tailings outlet 45 by the suction pump 47.

As in the case of the first embodiment the primary static member 36 prevents compacting of the particulate material and ensures efficient separation of the particles in the water. Again the vessel may be rotated at speeds in excess of the critical speeds normally present in an apparatus not having the static member.

One or more secondary static members of the type described in the first embodiment may also be included. The rotational members are preferably located between the static members.

Figure 4:
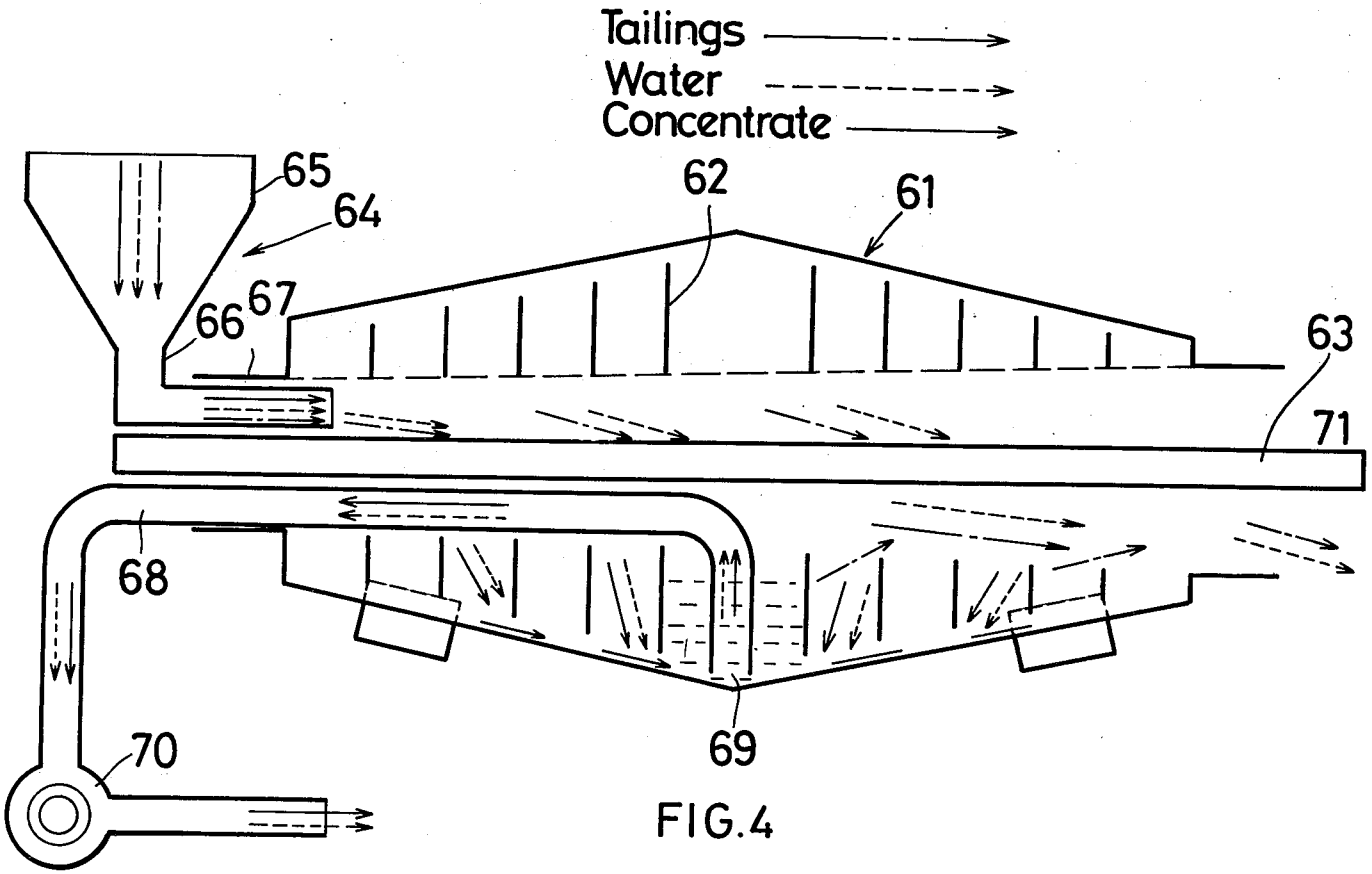
FIG. 4 is a diagrammatic cross-sectional elevation and flow diagram of a third embodiment of the invention.

In the third embodiment of the invention as shown in FIG. 4, an apparatus comprises an elongated cylindrical vessel 61. This vessel 61 has its maximum diameter in its centre and tapers towards each end in a frusto-conical manner.

The vessel 61 is rotatably mounted with its axis substantially horizontal. Conveniently the vessel 61 may be located on a roller bed comprising at least one pair of rollers near each end of the vessel. Furthermore, there is at least one drive roller in the roller bed which frictionally engages the vessel and is driven by an electric motor, for example.

Within the vessel and spaced along the length thereof are a plurality of annular static discs 62 which extend transversely to and are co-axial with the axes of the vessel. The static discs are mounted to a co-axial static shaft 63 which extends through the vessel.

A feed inlet 64 comprises a hopper 65 and an inlet pipe 66, the latter entering the one open end 67 of the vessel near the top thereof. The inlet pipe is located inside the apertures of the static discs 62.

A concentrate outlet pipe 68 also enters the vessel 61 via the end 67. The pipe 68 travels along the inside of the apertures of the static discs 63 until it reaches the point of maximum diameter of the vessel. Here it bends downwardly to terminate in a concentrate outlet 69 adjacent the lowest part of the cylindrical wall of the vessel. The outlet pipe leads to a suction pump 70.

The second end 71 of the vessel has a somewhat larger opening than the first end and this end 71 forms the tailings discharge for the vessel.

In operation the vessel rotates at as slow a speed as possible depending upon the ore being treated. The slower the speed, the more rapid and effective the concentration of particles.

Ore particles and water in correct ratio enter the vessel via the inlet 64 to pass through the centres of the static disc 6 and also beneath the discs 62 between the edges and the moving wall of the vessel, to the far or discharge end.

During this throughflow of the fluid/solid content, higher specific gravity particles forming the concentrate immediately settle out, automatically gravitating towards the concentrating area (being the section of maximum diameter) where they accumulate until removal. As concentrates increase in volume they force the lower specific gravity ore particles out and away to be discharged via the tailings outlet 71. As the vessel operates horizontally, higher specific gravity particles will gravitate towards the centre section from either end.

The solids content in transit through the vessel passes through the centre of the static discs and also beneath them the lighter specific gravity material in suspension flowing through the upper section of the fluid/solid mass while the higher specific gravity particles settle out as concentrate.

Depending upon rotational speed, the static discs 62 play a very important part in the operation of the classifier: Firstly, due to the position of the discs within the moving body of the vessel, these impart a slicing action within a moving fluid/solid mass compacting within itself. Such compacted masses would prove detrimental to any operation preventing settlement of concentrate particles thus resulting in loss of valuable mineral. The slicing action breaks up such masses thereby obviating the possibility of further compacting, thus ensuring and resulting in maximum fluidity.

Secondly, depending upon distances between discs, and the rotational speed of the vessel, a dragging action is created through friction against the sides or faces of the discs, resulting in:

(a) The interparticle movement necessary to achieve a gravity separation and concentration of a heterogeneous size range of mineral in one operation ranging from ultra coarse to ultra fine particles utilising ordinary water.

(b) The interparticle movement necessary to maintain the fluid/solid mass in loose suspension ensuring maximum fluidity and also a minimum viscosity rate.

(c) The prevention of compacting against the wall of the drum.

(d) The prevention of moving tightly packed masses occurring due to too low rotational speeds.

Figure 5:
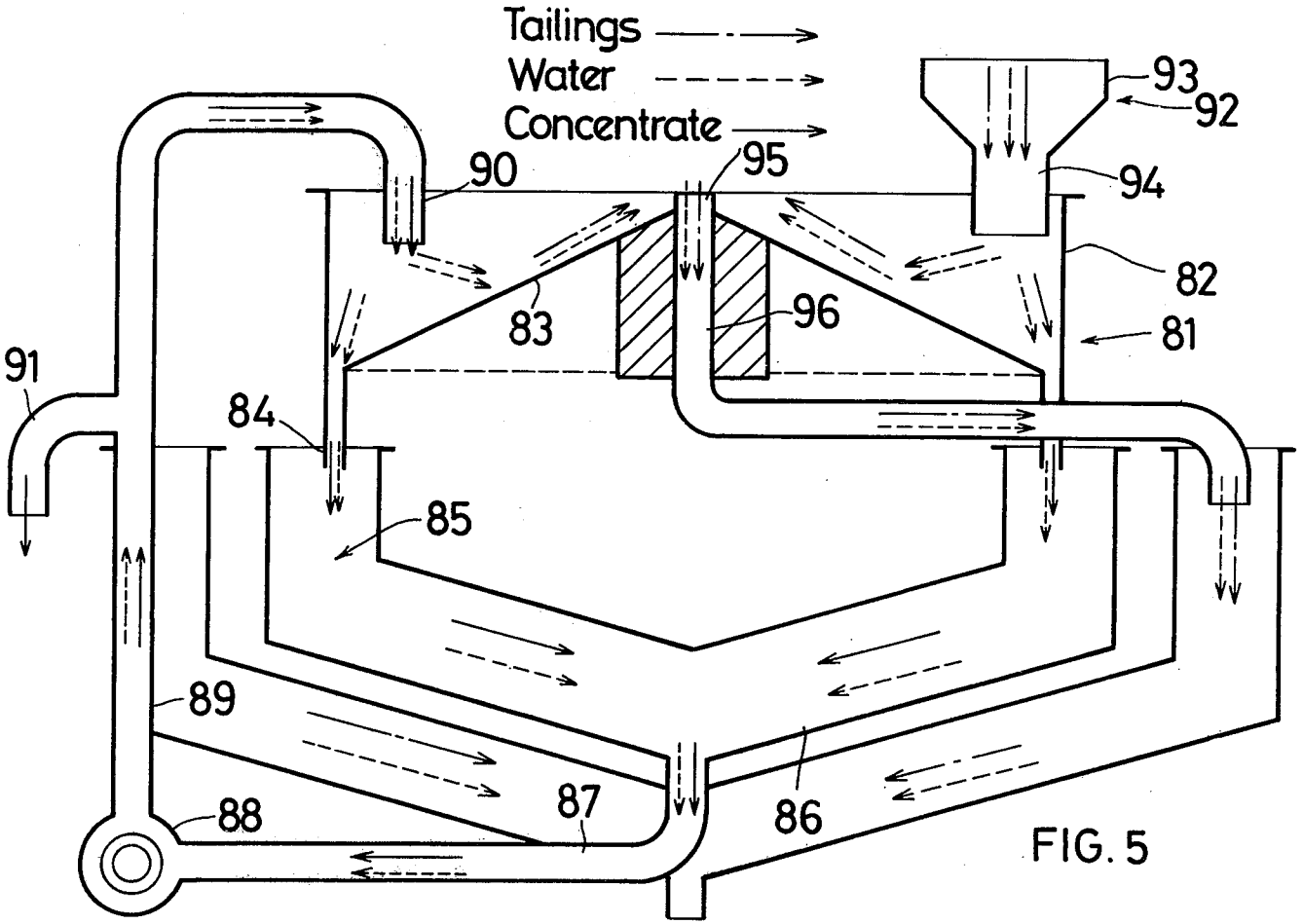
FIG. 5 is a diagrammatic cross-sectional elevation and flow diagram of a fourth embodiment of the invention.

The fourth embodiment of an apparatus is shown in FIG. 5 and comprises a vessel 81 in the form of a right circular cylindrical member 2 mounted to be rotatable about its axis which is substantially vertical. The bottom 3 of the vessel is in the form of a co-axial inwardly directed frusto-conical member.

Around the bottom periphery of the vessel are a number of spaced concentrate outlets 4 in the form of short downwardly depending pipes. These outlets discharge into an annular launder 85. From the bottom 86 of the launder a pipe 87 leads to a pump 88 and a pipe 89 leads from the outlet of pump 88 to discharge into the top of the vessel at 90. Midway between the pump 88 and the discharge point 90 is a controllable bleed off pipe 91 for the concentrate.

A particulate feed inlet 92 comprising a hopper 93 and a feed pipe 94 is located above the vessel to discharge into the vessel at a point about midway up the vessel wall.

A tailings outlet 95 is located at the apex of the frusto-conical bottom 83. This outlet comprises a pipe 96 which extends radially outwardly to discharge in a tailings launder 97.

In use the vessel 1 is rotated about its axis and particulate material conveyed in a suitable amount of water is introduced into the vessel via the feed inlet 92. The particles of higher specific gravity tend to move outwards and downwards to a greater degree than the particles of lower specific gravity. Furthermore, the particulate material tends to form a reversed gravitational bed.

The second phenomonen, and also the tendency of particles to pack at the cylindrical member are obviated in the following manner: The concentrate is continuously drained from the vessel via the outlets 84 into the launder 85. From here it is recirculated to the vessel. In this way the nature of the concentrate is improved and when, with the increasing feed to the vessel, the amount of concentrate reaches a predetermined value, some is bled off via the pipe 91. This may be done automatically by monitoring the power required to rotate the vessel; this will increase as the amount of concentrate increases.

In embodiments 1, 2 and 4 the feed inlet may feed onto a co-axial spreader cone located in the top of the vessel. In this way the feed is evenly distributed around the periphery of the vessel.

The invention thus provides a method which may be used to provide for improved concentration of particulate material.

It should be noted here that other embodiments are envisaged within the scope of the invention. More particularly the apparatus may be used to treat other types of particulate material and depending on the material other liquids and gases may be used.

The invention also provides an apparatus for and method of concentrating according to specific gravity in which a long range feed may be treated without resorting to heavy media such as ferrosilicon suspensions.

What I claim as new and desire to secure by Letters Patent is:

1. An apparatus for separating particles having a specific gravity above a predetermined value in a fluid suspension from particles having a specific gravity below a predetermined value in the fluid suspension comprising:

a cylindrical vessel rotatable about its axis;

a feed inlet for introducing particulate material suspended in a fluid into the vessel;

a concentrate outlet for particles having a specific gravity above the predetermined value; and means for preventing particles from packing together at the cylindrical wall of the vessel during rotation thereof at speeds in excess of the critical speeds of the particles having a specific gravity above the predetermined value.

2. An apparatus as claimed in claim 1 further including means for rotating the vessel.

3. An apparatus as claimed in claim 1 in which the vessel is open at the top thereof and is mounted so that its axis is substantially upright in operation.

4. An apparatus as claimed in claim 3 in which the vessel is circular cylindrical.

5. An apparatus as claimed in claim 3 in which the vessel decreases in diameter towards its top.

6. An apparatus as claimed in claim 3 in which the means for preventing particles from packing at the cylindrical wall comprises a primary static member of a thin walled annular cylindrical configuration located co-axially within the vessel adjacent the cylindrical wall and extending from near the bottom of the vessel to a height corresponding to at least the height of the area within the vessel in which the particles of higher specific gravity than the predetermined value are collected.

7. An apparatus as claimed in claim 6 in which there is at least one secondary static member spaced inwardly from the primary static member and the secondary static member is a thin walled annular member co-axial with the vessel and is spaced from the bottom thereof.

8. An apparatus as claimed in claim 6 in which there is at least one thin walled annular cylindrical member spaced inwardly from the cylindrical wall of the vessel, spaced from the bottom thereof, and rotatable with the vessel.

9. An apparatus as claimed in claim 1 in which the cylindrical vessel comprises an elongated cylinder open at each end and having a maximum diameter near the centre, the vessel thereof being mounted for rotation such that its axis is substantially horizontal and having the feed inlet at one open end of the vessel, the tailings outlet at the open other end of the vessel and the concentrate outlet at the lowest part of the maximum diameter of the vessel.

10. An apparatus as claimed in claim 9 in which the cylindrical wall comprises two adjacent frusto-conical sections.

11. An apparatus as claimed in claim 9 in which the means for preventing particles from adhering to the cylindrical wall comprises a plurality of spaced annular static discs co-axially mounted within the vessel, the periphery of the discs being spaced from the cylindrical wall of the vessel.

* * * * *